US005895151A

United States Patent [19]

Kinoshita et al.

[11] Patent Number: 5,895,151

[45] Date of Patent: Apr. 20, 1999

[54] DEVELOPING APPARATUS HAVING REGULATING BLADE

[75] Inventors: Masahide Kinoshita; Kazuhisa Kemmochi; Takashi Shibuya, all of Shizuoka-ken, Japan

[73] Assignee: Canon Kabushiki Kaisha, Tokyo, Japan

[21] Appl. No.: 08/871,962

[22] Filed: Jun. 10, 1997

[30] Foreign Application Priority Data

Jun. 10, 1996 [JP] Japan ..... 8-170546

[51] Int. Cl.[6] ..... G03G 15/08

[52] U.S. Cl. ..... 399/284

[58] Field of Search ..... 399/274, 284, 399/103, 105, 273, 283

[56] References Cited

U.S. PATENT DOCUMENTS

| | | | |
|---|---|---|---|
| 4,575,220 | 3/1986 | Sakamoto et al. | 399/267 |
| 4,796,561 | 1/1989 | Takano et al. | 399/274 |
| 5,086,728 | 2/1992 | Kinoshita . | |
| 5,134,960 | 8/1992 | Shirai | 399/105 |
| 5,210,575 | 5/1993 | Kikuchi | 399/284 |
| 5,287,150 | 2/1994 | Kinoshita et al. . | |
| 5,311,264 | 5/1994 | Kinoshita . | |
| 5,338,895 | 8/1994 | Ikegawa et al. . | |
| 5,424,812 | 6/1995 | Kemmochi et al. . | |
| 5,461,465 | 10/1995 | Sunaga et al. | 399/274 |
| 5,475,467 | 12/1995 | Watanabe et al. . | |
| 5,552,867 | 9/1996 | Sekino et al. | 399/284 |
| 5,585,895 | 12/1996 | Yashiro et al. . | |
| 5,587,551 | 12/1996 | Ikegawa et al. | 399/1 |

FOREIGN PATENT DOCUMENTS

| | | |
|---|---|---|
| 0-810488 | 3/1997 | European Pat. Off. . |
| 59-33471 | 2/1984 | Japan . |
| 61-185772 | 8/1986 | Japan . |
| 61-223868 | 10/1986 | Japan . |
| 3-260677 | 11/1991 | Japan . |

OTHER PUBLICATIONS

Patent Abstracts of Japan, vol. 008, No. 129 (P–280), Jun. 15, 1984.

Patent Abstracts of Japan, vol. 011, No. 058 (P–550), Feb. 21, 1987.

Patent Abstracts of Japan, vol. 011, No. 009 (P–534), Jan. 10, 1987.

Patent Abstracts of Japan, vol. 016, No. 065 (P–1313), Feb. 18, 1992.

*Primary Examiner*—Robert Beatty

*Attorney, Agent, or Firm*—Fitzpatrick, Cella, Harper & Scinto

[57] ABSTRACT

A developing apparatus includes a developer container for containing a developer; a developer carrying member, disposed in an opening of the developer container, for carrying the developer; an elastic blade for forming a nip between the developer carrying member to regulate an amount of the developer on the developer carrying member; wherein a distance between the nip and an outwardly extending upstream end of the elastic blade with respect to a movement direction of the developer carrying member continuously increases from a longitudinal end of the elastic blade toward longitudinally central portion.

10 Claims, 5 Drawing Sheets

DEVELOPING APPARATUS HAVING REGULATING BLADE

FIELD OF THE INVENTION AND RELATED ART

The present invention relates to a developing apparatus employed in an image forming apparatus such as a copy machine, a printer, or the like, of an electrophotographic or electrostatic recording type, to develop an electrostatic image on an image bearing member.

In an image forming apparatus of an electrophotographic or electrostatic recording type, an electrostatic latent image formed on an image bearing member is visualized as a toner image using a developing apparatus.

As such a developing apparatus, various developing apparatuses employing a dry development process and a single component developer have been proposed, and some of them have been put to practical use. In the case of a developing apparatus employing a dry development process, a thin toner layer must be formed on a developer carrying member.

As for a method for forming this thin toner layer, Japanese government journal Tokkai No. 43,038/1979 discloses a method, according to which an elastic toner regulating blade of rubber or metallic material (hereinafter, elastic blade) is placed in contact with a developing sleeve as a developer carrying member, and the toner carried on the developing sleeve is passed under the elastic blade, in contact with the tip of the elastic blade, being formed into a thin toner layer, and at the same time, the toner is triboelectrically charged to a satisfactory potential level.

FIG. 7 is a section of a conventional developing apparatus employing an elastic blade to regulate the thickness of a toner layer. The apparatus in this drawing employs a nonmagnetic single component toner as the developer.

In the case of this conventional developing apparatus 50, an elastic roller 55 composed of foamed polyurethane, sponge, or the like material, or comprising a fur brush, is disposed in a developer container, which contains nonmagnetic toner as a single component developer, in contact with a developing sleeve 52, on the upstream side of the developing sleeve 52 relative to the rotational direction of the developing sleeve 52, and is rotated in the direction of an arrow mark D to deliver toner onto the peripheral surface of the developing sleeve 52.

As the developing sleeve 52 is rotated, the toner 53 derived onto the surface of the developing sleeve 52 is conveyed to where the elastic blade 51 and the developing sleeve 52 make contact, being formed into a thin layer of toner, and then, is supplied to the electrostatic latent image on a photosensitive member 1. A part of the toner 53, which remains on the development sleeve 52, that is, a part of the toner 53, which is not consumed for the development of the latent image, is stripped by the elastic roller 55. Thereafter, a new supply of toner 53 is delivered to the developing sleeve 52 by the elastic roller 55 as described above, starting the next cycle of the process described above.

In a case in which metallic material is used as the material for the developing sleeve 52, it is not recommended to employ a metallic plate as the material for the elastic blade 51 from the standpoint of the frictional wear on the developing sleeve side, and in order to form a desirable toner layer, it is necessary to employ a rubber material such as urethane, silicon rubber, or the like.

Further, in the case of an apparatus such as those described above, the longitudinal end portions must be sealed to prevent toner from leaking therefrom.

In particular, in the case that the developing apparatus 50 is of a type which employs nonmagnetic toner, it is more difficult to prevent the toner 53 from leaking out of the developing apparatus 50 than in the case that the development apparatus 50 is of a type which employs magnetic toner, since a developing apparatus employing nonmagnetic toner cannot take advantage of magnetic adhesive force as a developing apparatus employing magnetic toner can. More specifically, in the case of a developing, apparatus employing nonmagnetic toner, the developing sleeve 51 is not capable of retaining the toner particles except for those sufficiently charged as they go through the contact nip between the elastic blade 51 and developing sleeve 52, and therefore, the leaking of toner from the bottom portion and/or the adjacencies of the longitudinal end of the developing sleeve 52, that is, the so-called toner leakage, is liable to occur, and such leakage is liable to invite a problem: the interior of the image forming apparatus is soiled by toner.

Therefore, a flexible sealing member 56 is placed at a toner recovering portion, which is the bottom portion of a developer container 54, in contact with the developing sleeve 52, with slight contact pressure, to prevent the toner 53 in the developer container 54 from leaking out from the bottom portion of the developer container 54, but allow the residual toner to be carried back into the developer container 54. Further, another sealing member 57 is disposed at the longitudinal end of the developing sleeve 52.

FIG. 8 is a schematic view of the developing apparatus 50 illustrated in FIG. 7, as seen from the direction of the photosensitive member 1. For the sake of convenience in describing the internal structure of the apparatus, the developing sleeve 52 is eliminated from the drawing, and the nip between the elastic blade 51 and the developing sleeve 52 is indicated by hatching.

Referring to FIG. 7, an end seal 57 composed of fibrous material such as woolen felt, Teflon pile, or the like, or foamed material such as urethane foam, sponge rubber, or the like is placed in the gap formed between the developing sleeve 52 and the surface of the opening of the developer container, at each longitudinal end of the developing sleeve 52, to prevent the toner leakage from the gaps. Further, each of the longitudinal end portions of the elastic blade 51 is held between the developing sleeve 52 and the end seal 57; in other words, the elastic blade 51 is pressed from behind onto the developing sleeve 52 by the end seal 57, to prevent the toner leakage from the longitudinal end portion of the developing blade 51.

However, in the case of the above described conventional structure, in order to reliably seal the gaps, the end seal 57 must be pressed on the developing sleeve with a force that generates contact pressure exceeding a predetermined value. Application of such force causes the elastic blade 51 to deform at the longitudinal end held between the developing sleeve 52 and the end seal 57, in a manner to conform to the contour of the peripheral surface of the developing sleeve 52, starting from the the nip portion to the free end edge, which in turn causes the elastic blade 51 to slightly lift at the immediately inward portion from the end seal 57. As a result, the developer layer formed on this particular portion of the developing sleeve 52 becomes thicker than the developer layer on the other portions, which causes the toner 53 in this portion of the toner layer to be insufficiently charged. Consequently, the toner 53 transfers from the longitudinal end portions of the developing sleeve 52 to the photosensitive member 1 during a developing process, making a finished image appear foggy, or scatters from the longitudinal end portion of the developing sleeve 52.

Even when the end seal 57 is placed in contact with the longitudinal end surface of the elastic blade 51 to prevent the aforementioned deformation of the elastic blade 51, the movement of the toner 53 adjacent to the wall of the developer container 54 is inferior to that at the more inward portion, and as a result, the toner 53 adjacent to the wall of the developer container 54 is more firmly rubbed onto the surface of the developing sleeve 52 than the toner 53 at the more inward portion of the developer container 54. Consequently, the toner layer becomes thicker at the longitudinal end of the elastic blade 51, causing the same problems as described above.

As a solution to the above problems, Japanese government journal Tokki No. 185,772/1986 proposes to rectangularly cut off the longitudinal end of the elastic blade, on the free end edge side.

FIG. 9 depicts a developing apparatus comprising an elastic blade 58, both longitudinal ends of which were rectangularly cut off, on the free end edge side, by the inventors of the present invention, to prevent the elastic blade 58 from being deformed unless the longitudinal end portion is modified as described above. This arrangement makes it possible to form a desirable thin layer of nonmagnetic toner on the developing sleeve as well as to prevent the toner leakage from the longitudinal ends of the developing sleeve 52 and the elastic blade 58, and therefore, makes it possible to desirably develop an electrostatic latent image on the photosensitive member 1 as an image bearing member.

However, in the case of the developing apparatus illustrated in FIG. 9, as a developing operation is repeated a large number of times, the toner 53 enters between the end seal 57 and the developing sleeve 52, covering the developing sleeve 52, on the peripheral surface area in contact with the end seal 57, by embedding itself therein, or becoming aggregated thereon, which extremely reduces the airtightness of this portion. Consequently, the toner 53 leaks out, or a massive amount of aggregated toner moves into the adjacencies of the end portion of the elastic blade 58, some of it being caught in the contact nip between the elastic blade 58 and the developing sleeve 52. The aggregated toner caught in the contact nip prevents the corresponding portion of the developing sleeve 52 from being coated with the toner, effecting white streaks in a finished image. This process will be described below in more detail.

As the developing sleeve 52 is rotated, the toner 53 collects on the surface of the free end edge of the narrowed portion of the elastic blade 58, and gradually travels on the surface toward the longitudinal end of the elastic blade 58 as a developing operation is repeatedly carried out a large number of times, eventually entering between the end seal 57 and the developing sleeve 52 through a minuscule space formed by the end seal 57, developing sleeve 52, and the surface of the free end edge of the narrowed portion of the elastic blade 58. As a result, the end seal 57 is gradually covered with the toner 53, on the peripheral surface area in contact with the developing sleeve 52.

This toner invasion was more conspicuous when usage was made of such toner that has an advantage in that it is superior in transferability from an image bearing member to a transfer material by an unillustrated transferring means, and displays high lubricity when the toner remaining on the image bearing member after image transfer is cleaned by a cleaning means such as a blade, a fur brush, or the like, that is, when toner composed of spherical toner particles with a smooth surface is used (shape factor SF-1 is in a range of 100–180, and shape factor SF-2 is in a range of 100–140; this will be described later in detail). This is because the toner particles in such toner are inferior in mutual adhesion.

Regarding the problem described above, it is conceivable to place the end seal 57 in contact with the longitudinal end surface of the elastic blade 58. With the adoption of such a structure, the phenomenon that the toner 58 invades the contact area between the end seal 57 and the developing sleeve 57 by traveling on the free end edge of the elastic blade 58 will disappear. Further, since the longitudinal end portion of the elastic blade 58 is rectangularly cut off, on the free end edge side, the longstanding) problem which occurs when the end seal 57 is placed in contact with the longitudinal end surface of the elastic blade 51, that is, the problem that a thicker toner layer is formed adjacent to the longitudinal end of the elastic blade 51 because the movement of the Loner 53 is poor adjacent to the wall of the developer container compared to that in the longitudinally central portion thereof, and resultantly, the toner is more firmly rubbed onto the surface of the developing sleeve 52, can be prevented.

However, even when the above structure is adopted, the following problem still occurs as a developing operation is repeatedly carried out a large number of times.

That is, the toner collects at the inward corner (position Y in FIG. 9) of the rectangularly trimmed free end edge of the elastic blade 58, and gradually grows into a thick layer of toner, which causes the toner to develop less electrical force for adhering to the developing sleeve 52. As a result, the toner 53 forming this thick layer is improperly transferred onto the photosensitive drum 1, creating fog, or separates from the surface of the developing sleeve 52 and falls into the internal space of an image forming apparatus, seriously soiling the interior the image forming apparatus.

Further, as a developing operation is repeated, a crack develops from the corner Y of the rectangularly trimmed portion of the elastic blade 58, and sometimes, the toner 53 leaks through this crack. This type of toner leakage is also conspicuous when toner composed of spherical toner particles with a smooth surface (shape factor SF-1 is in a range of 100–180; shape factor SF-2 is in a range of 100–140) is employed. This is because such toner particles are inferior in mutual adhesion.

The research pertaining to the above described problem revealed the following fact regarding the formation of the thin layer of toner. That is, as the developing sleeve 52 is rotated, the toner 53 collects in the wedge-shaped space surrounded by the surface area, from the contact nip to the free end edge, of the elastic blade 58, and the peripheral surface of the developing sleeve 52. Then, a portion of the toner collecting in this space becomes loose from the wedge-shaped space and is thinly coated on the developing sleeve 52, forming thereby a thin layer of toner on the developing sleeve 52. During this toner layer forming process, the surface area, from the contact nip to the free end edges, of the elastic blade 58 is continuously subjected to such force that works in the direction to lift the elastic blade 58 away from the developing sleeve 52. However, the longitudinal end portion of the elastic blade 58 has been rectangularly trimmed on the free end edge side, and therefore, it is barely subjected to the upward force. Consequently, distortional stress is concentrated to the corner Y of the rectangularly trimmed portion, and as a developing operation is repeated, this concentration of stress causes small cracks to develop at the corner Y, since the elastic blade 58 is composed of rubber material such as urethane rubber or silicon rubber. Eventually, the cracks grow larger and cause the aforementioned problems.

SUMMARY OF THE INVENTION

The primary object of the present invention is to provide a developing apparatus which does not allow toner to scatter or leak from the longitudinal end portion of the developer carrying member.

Another object of the present invention is to provide a developing apparatus capable of reliably forming a thin layer of toner on the developer carrying member with the use of an elastic blade.

According to an aspect of the present invention, a developing apparatus in accordance with the present invention comprises:

a developer container for containing developer;

a developer carrying member which is disposed across the opening of said developer container, and carries the developer; and an elastic blade which regulates the amount of developer to be carried on said developer carrying member, by forming a nip in conjunction with said developer carrying member;

wherein, the distance from the upstream edge of the nip, relative to the rotational direction of said developer carrying member, to the free end edge of said elastic blade gradually increases.

These and other objects, features and advantages of the present invention will become more apparent upon a consideration of the following description of the preferred embodiments of the present invention, taken in conjunction with the accompanying drawings.

DETAILED DESCRIPTION OF THE PREFERRED EMBODIMENTS

Hereinafter, the embodiments of the present invention will be described with reference to the drawings.

Figure 1:
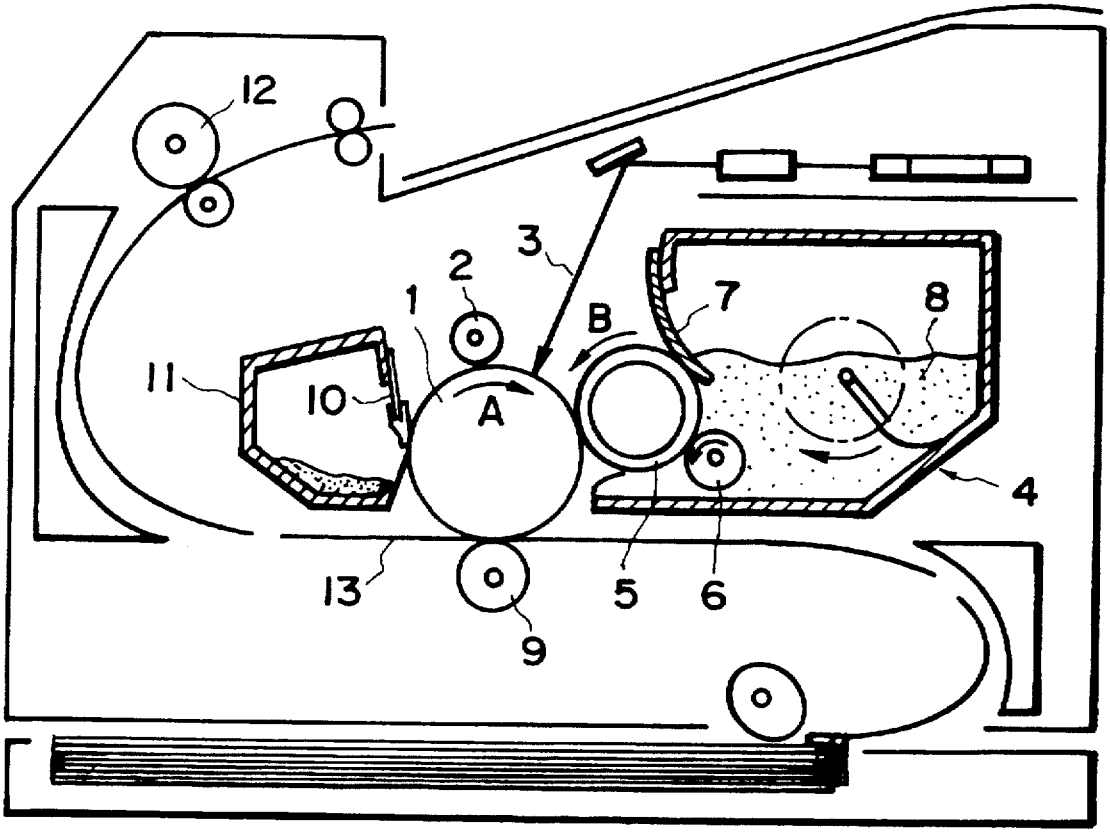
FIG. 1 is a schematic section of an image forming apparatus compatible with the developing apparatus in an embodiment of the present invention.
Figure 2:
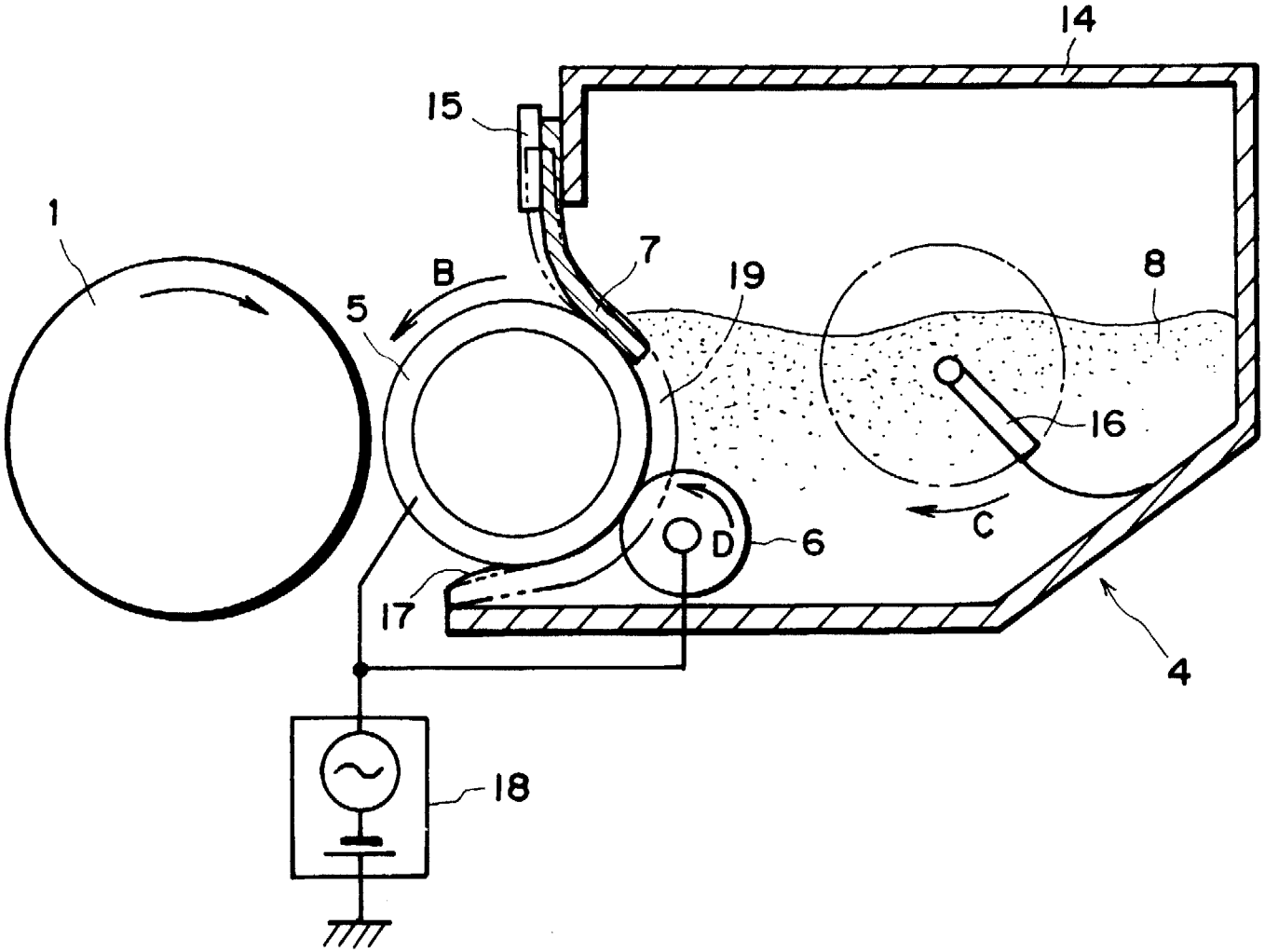
FIG. 2 is a schematic section of the developing apparatus illustrated in FIG. 1.
Figure 3:
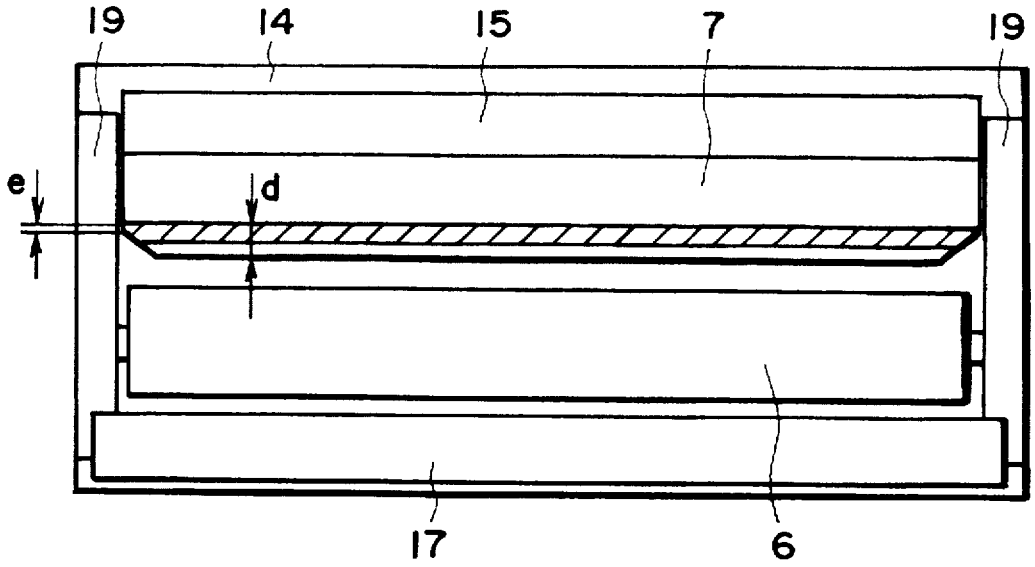
FIG. 3 is a schematic view of the developing apparatus illustrated in FIG. 2, as seen from the direction of the photosensitive member.

FIG. 1 is a schematic section of an image forming apparatus employing a developing apparatus in accordance with the present invention, and FIGS. 2 and 3 are a sectional view, and a front view, respectively, of the developing apparatus illustrated in FIG. 1.

In the image forming apparatus illustrated in FIG. 1, a photosensitive drum 1 as an image bearing member rotates in the direction indicated by an arrow mark A, and is uniformly charged by a charging apparatus 2 for charging the photosensitive drum 1 Then, an electrostatic latent image is formed on the peripheral surface of the photosensitive drum 1 by a laser beam 3 as exposing means for writing an electrostatic image.

This electrostatic latent image is developed, that is, visualized, into a toner image by the developing apparatus 4 in the form of a process cartridge removably installable in, the image forming apparatus adjacent to the photosensitive drum 1. The development process employed in this embodiment is a so-called reversal development process in which toner is adhered to the areas exposed to the laser beam 3.

The toner image, that is, the visual image, is transferred onto a paper 13, a recording medium, by a transfer roller 9. The toner which fails to be transferred and remains on the photosensitive drum 1 is scraped into a waste toner container 11 by a cleaning blade 10. After cleaning, the photosensitive drum 1 is used again for the next cycle of the above described image forming process.

On the other hand, the sheet 13 onto which the toner image has been transferred is put through a fixing apparatus 12, in which the toner image is fixed to the sheet 13, and then, the sheet 13 with the fixed toner image is discharged from the image forming apparatus, completing a single cycle of the printing operation.

Next, referring to FIG. 2, the developing apparatus 4 will be described in more detail. In the drawing, the developing apparatus 4, which visualizes the electrostatic latent image on the photosensitive drum 1 through a development process, comprises a developer container 14 which contains nonmagnetic toner 8, which is single component developer, and a developing sleeve 5 as a developer carrying member positioned across the oblong opening of the developer container 14. The opening of the developer container 14 extends in the longitudinal direction of the developer container 14, and the developing sleeve 5 opposes the photosensitive drum 1 through this oblong opening.

The developing sleeve 5 is disposed in such a manner that the approximately right-hand half of the peripheral surface of the developing sleeve 5 is hidden in the developer container 14, and the approximate left-hand half is exposed from the developer container 14. This exposed surface area of the developing sleeve 5 opposes the photosensitive drum 1 located on the left side of the developing apparatus 4, maintaining a microscopic gap between itself and the photosensitive drum 1.

The developing sleeve 5 is rotatively driven in the direction indicated by an arrow mark B. The surface of the developing sleeve 5 is rendered reasonably uneven so that the chance of frictional contact with the toner 8 increases, and the toner 8 is desirably conveyed. In this embodiment, it is made of an aluminum sleeve with a diameter of 16 mm. Its surface is blasted with glass beads (#600) to give it a roughness (Rz) value of approximately 3 μm. It is positioned so that the gap between the peripheral surfaces of the developing sleeve 5 and the photosensitive drain 1 becomes 300 μm. As for the peripheral velocity of the developing sleeve 5, it is 80 mm/sec, being slightly faster than that of the photosensitive drum 1, which is 50 mm/sec.

In order to prevent the toner leakage from the longitudinal end portion of the developing sleeve 5, an end seal 19 is attached along the lateral edge of the opening of the developer container 14 to seal the developer container 14 at the longitudinal end portion of the developing sleeve 5. The structure, inclusive of the end seal 19, for sealing the developer container 14 at the longitudinal end portion of the developing sleeve 5 will be described later in detail.

Above the developing sleeve 5, a toner layer regulating elastic blade (hereinafter, elastic blade) 7 which is composed of rubber material such as urethane or silicon rubber, or a thin plate of metallic material such as resilient SUS or phosphor bronze is supported by a blade supporting metallic plate 15. The surface of the elastic blade 7 is in contact with the peripheral surface of the developing sleeve 5, slightly inward of the free end edge. The orientation of the elastic blade 7 relative to the developing sleeve 5 is the so-called counter direction; in other words, the free end edge of the elastic blade 7 is on the upstream side of the contact area with reference to the rotational direction of the developing sleeve 5.

The elastic blade 7 is constituted of the blade supporting metallic plate 15 and a piece of 1.0 mm thick urethane rubber blade glued to the plate 15. The contact pressure between the elastic blade 7 and the developing sleeve 5 is set to 30 g/cm. The linear pressure is calculated from the value obtained in the following manner: three pieces of thin metallic plate with a known friction coefficient are inserted between the elastic blade 7 and the developing sleeve 5, and the force necessary to pull out the center piece is measured using a spring type scale. The structure of the longitudinal end portion of the elastic blade 7 in this embodiment will be described later in detail.

An elastic roller 6 is rotatively supported in contact with the peripheral surface of the developing sleeve 5, on the upstream side, relative to the rotational direction of the developing sleeve 5, of the contact area between the elastic blade 7 and the developing sleeve 5. As for the structure of the elastic roller 6, a self-supporting foamed sponge structure, or a fur brush structure comprising a metallic core and fibrous material such as rayon fiber or nylon fiber planted on the metallic core is desirable from the standpoint of the ease with which toner 8 can be transferred onto the developing sleeve 5, and the residual toner on the developing sleeve 5 can be stripped. The elastic roller 6 in this embodiment is 12 mm in diameter and is constituted of a metallic core and a layer of urethane foam covering the metallic core.

As for the width of the contact between the elastic roller 6 and the developing sleeve 5, a range of 1–8 mm is effective. Further, it is desirable for the elastic roller 6 to have velocity relative to the sleeve 5, at the contact. In this embodiment, the contact width is set to 3 mm, and in a developing process, the elastic roller 6 is rotatively driven by an unillustrated driving means at the peripheral velocity of 50 mm/sec (so that relative velocity to the sleeve 5 becomes 130 mm/sec) with a predetermined timing.

The toner 8 employed in this embodiment is a nonmagnetic single component developer, which has an advantage in that it is superior in transferability, and displays high lubricity when the toner which fails to be transferred from the photosensitive drum 1 and remains thereon is cleaned by a cleaning means such as a blade or a fur brush; in other words, it is toner composed of spherical toner particles with a smooth surface. In more concrete terms, the shape factor SF-1 is in a range of 100–180, and the shape factor SF-2 is in a range of 100–140.

The shape factors SF-1 and SF-2 are defined as values obtained using the following method. One hundred toner images are randomly sampled using an FE-SEM (S-800), a product of Hitachi, Ltd., and their image data are fed into an image analyzing apparatus (Luzex 3), a product of Nikon Corp. Then, the obtained results are used to calculate the shape factors using the following mathematical formulas:

$$SF\text{-}1=\{(MXLNG)2/AREA\}\times(\pi/4)\times 100$$

$$SP\text{-}2=\{(PERI)2/AREA\}\times(\pi/4)\times 100$$

(MXLNG: absolute maximum length; AREA: projected area of toner; PERI: peripheral length)

The shape factor SF-1 indicates degree of sphericity, and as the shape factor SF-1 increases from a value of 100, the shape of the toner particle becomes less spherical or irregular. The shape factor SF-2 indicates degree of surface unevenness, and as the shape factor SF-2 increases, the surface unevenness of toner becomes conspicuous.

As for a method for producing toner, various methods are usable in addition to the so-called pulverization method, as long as the aforementioned shape factors of toner remain within the ranges described above; for example, a method for directly producing toner using the suspension polymerization method disclosed in Japanese government journal Tokkai Nos. 10,231/1961 and 53,856/1984, or a dispersion polymerization method in which toner is directly produced using aqueous organic solvent in which monomer is soluble but polymer is insoluble, or an emulsification polymerization method represented by a soap free polymerization method in which toner is directly polymerized with the presence of water soluble polarity initiator.

In this embodiment, a normal pressure or pressurized suspension polymerization method is used. According to this method, the shape factors SF-1 and SF-2 can be easily kept within the ranges of 100–180 and 100–140, respectively, and toner having a sharp particle size distribution can be easily produced.

The particle size of the thus obtained toner is in a range of 4–8 μm. As for the materials used for the toner production, styrene and n-butylacrylate as monomer, metallic salicylate compound as charge control agent, saturated polyester as polarity resin, and coloring agent, are used to produce colored suspension particles having a weight average particle diameter of 7 μm.

Then, hydrophobic silica is added by 1.5 wt. % to create the negatively chargeable toner 8 which is superior in transferability, and is less liable to wear the photosensitive drum 1 during cleaning.

In the developing apparatus 4 described above, the toner 8 in the developer container 14 is fed toward the elastic roller 6 as a stirring member 16 is rotated in the direction indicated by an arrow mark C during a developing operation.

Then, the toner 8 is delivered to the adjacencies of the developing sleeve 5 as the elastic roller 6 is rotated in the direction of an arrow mark D, and is adhered, while being triboelectrically charged, to the peripheral surface of the developing sleeve 5 as the toner 8 carried on the peripheral surface of the elastic roller 6 is rubbed against the peripheral surface of the developing sleeve 5.

Thereafter, as the developing sleeve 5 is rotated in the direction of an arrow mark B, the toner 8 adhering to the developing sleeve 5 comes under the pressure from the elastic blade 7, whereby it is formed into a thin layer of toner while being triboelectrically charged to a proper level, and then, as the developing sleeve 5 is further rotated, it is carried to a developing station, that is, where the toner layer comes closest to the photosensitive drum 1.

In the developing station, the thin layer of toner 8 having been formed on the developing sleeve 5 develops an electrostatic latent image having formed on the photosensitive drum 1 into a toner image, as an AC voltage (development AC voltage) superimposed on a DC current is applied between the developing sleeve 5 and the photosensitive drum 1 by an electric power source 18; the electrostatic image on the photosensitive drum 1 is developed by the thin layer of toner 8.

The toner which is not consumed for development is recovered from the bottom portion of the developing sleeve 5 as the developing sleeve 5 is rotated. In this residual toner collecting portion, a sealing member 17 is disposed, which is formed of flexible sheet, and prevents the toner 8 in the developer container 14 from leaking from the bottom portion of the developer container 14, but allows the residual toner on the developing sleeve 5 to be carried into the developer container 14.

This recovered residual toner on the developing sleeve 5 is stripped from the surface of the developing sleeve 5 in the contact portion between the elastic roller 6 and the developing sleeve 5. As the elastic roller 6 is rotated, a major portion of the stripped toner mixes with the toner 8 contained in the developer container 14, the charge carried by the residual toner being dispersed into the toner 8 contained in the developer container 14, and at the same time, a new supply of toner is placed on the developing sleeve 5 by the rotating elastic roller 6. Then, the aforementioned process is repeated.

Next, the structure of the toner seal in accordance with the present invention, which is disposed at the longitudinal end portion of the developing sleeve 5, will be described in detail.

FIG. 3 is a schematic view of the developing apparatus 4 illustrated in FIG. 2, as seen from the direction of the photosensitive drum 1. For the sake of convenience in describing the structure, the developing sleeve 5 is eliminated from the drawing.

As depicted in FIG. 2, an end seal 19 composed of fibrous material such as woolen felt or Teflon pile, or foamed material such as foamed urethane or rubber sponge is placed along the edge of the opening of the developer container 14, to seal the gap between the longitudinal end portion of the developing sleeve 5 and the developer container 14. The end seal 19 in this embodiment is formed by placing Teflon pile on the woolen felt, and the Teflon pile side which is superior in "slickness" is placed in contact with the longitudinal end portion of the peripheral surface of the developing sleeve 5. Further, as illustrated in FIG. 3, the lateral surface of the end seal 19 is placed in contact with the longitudinal end surface of the elastic blade 7 surface to prevent the toner from leaking from the longitudinal end portion of the elastic blade 7.

Also referring to FIG. 3, the shape of the elastic blade 7 is rendered so that the distance from the hatched area, which corresponds to the nip formed between the elastic blade 7 and the developing sleeve 5, to the free end edge gradually decreases toward the longitudinal end, starting from the outermost point of the image developing region, and further, the outermost end of the free end edge falls within the aforementioned contact nip.

The thickness of the toner layer formed on the developing sleeve 5 is affected by the distance from the upstream edge of the contact nip, relative to the rotational direction of the developing sleeve 5, to the free end edge of the elastic blade 7. The longer this distance is, the thicker the toner layer formed on the developing sleeve 5 becomes, and the shorter it is, the thinner the toner layer becomes. In this embodiment, this distance is gradually reduced toward the longitudinal end, within the region in which the elastic roller 6 does not make contact with the developing sleeve 5, so that the toner regulating force of the elastic blade 7 is increased in this region. Further, in order to be sure that the toner layer on the developing sleeve 5 is regulated at the longitudinal end portion as properly as at the center portion, the elastic blade 7 is shaped so that the longitudinal end of the free end edge falls within the contact nip, and also, the longitudinal end of the peripheral surface of the developing sleeve 5 makes contact with the angularly trimmed portion of the free end edge of the elastic blade 7.

More specifically, referring to FIG. 3, in the normal developing range, the value of the distance d, that is, the distance from the downstream edge of the contact nip, relative to the rotational direction of the developing sleeve 5, to the free end edge of the elastic blade 7 is 1.5 mm, but in the region adjacent to the longitudinal end of the elastic blade 7, the distance d is gradually reduced toward the longitudinal end so that the distance e, that is, the distance d at the longitudinal end, is 0.5 mm.

It should be noted here that since the distance from the upstream edge of the contact nip, relative to the rotational direction of the developing sleeve 5, to the free end edge of the elastic blade 7 affects the amount of toner which the elastic blade 7 takes in, and therefore, this embodiment should be described with reference to this distance d. However, in this embodiment, in the longitudinal end region, the free end edge of the elastic blade 7 falls within the contact nip, which makes the distance from the upstream edge of the contact nip to the free end edge of the elastic blade 7, zero Therefore, for the sake of convenience in describing the present invention, this embodiment was described with reference to the distance from the downstream edge of the contact nip, to the free end edge of the elastic blade 7.

The value of this distance d is optionally determined to form and maintain the toner 8 layer of a desirable thickness on the developing sleeve 5, and should be properly adjusted according to the types of toner and developing sleeve. In this embodiment, it is adjusted to the aforementioned values to maintain the amount of toner at 0.6 mm/cm$^2$.

Also as described above, it is desirable that the position of the free end edge of the elastic blade 7 at the longitudinal end falls within the contact nip in order to increase the toner regulating force of the elastic blade 7 in the adjacencies of the longitudinal end thereof. Since the width of the contact nip in this embodiment is approximately 1.0 mm, the aforementioned distance e is made to be 0.5 mm so that the free end edge of the elastic blade 7 at the longitudinal end falls within the contact nip.

By giving the elastic blade 7 the above described configuration, the aforementioned problem inherent to an elastic blade with the conventional structure, that is, the concentration of stress to the corner point created as an elastic blade is rectangularly trimmed at the longitudinal end portion, on the free end edge side, can be prevented. Also, the phenomenon which occurs to the conventional elastic blade, that is, the phenomenon that the toner layer is formed undesirably thick at the longitudinal end portion of the developing sleeve 5 because there is less movement of the toner 8 adjacent to the wall of the developer container 14, that is, adjacent to the longitudinal end of the elastic blade, than across the longitudinally central portion of the developing sleeve 5, and therefore, the toner is more firmly rubbed onto the surface of the developing sleeve 5, can be prevented.

As a result, it is possible to reliably prevent such fog that is created by the toner which erroneously transfers from the longitudinal end portion of the developing sleeve 5 onto the photosensitive member during a developing process, as well as scattering and/or leaking of toner from the longitudinal end portion of the developing sleeve 5. In other words, a desirable thin layer of toner is reliably formed on the developing sleeve by the elastic blade, so that the electrostatic latent image on the photosensitive drum 1 can be desirably developed.

Further, by placing an end seal in contact with the longitudinal end surface of the elastic blade, the toner leak from the longitudinal end portion of the elastic blade can be reliably prevented without causing unnecessary deformation of the elastic blade.

Figure 4:
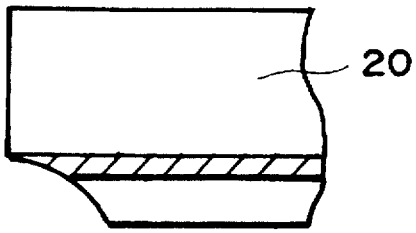
FIG. 4 is a schematic drawing depicting the modification of the developing apparatus illustrated in FIG. 2.

In this embodiment, the longitudinal end portion of the elastic blade 7 is given the configuration illustrated in FIG. 3 which makes the elastic blade 7 appear as if its longitudinal end portion was diagonally cut off. However, the longitudinal end portion of an elastic blade may be given such a configuration that is exemplified by an elastic blade 20 illustrated in FIG. 4, the longitudinal end portion of which has been trimmed in an arc-like pattern. In essence, the configuration of the elastic blade has only to be such that the distance from the upstream edge of the contact nip formed by the elastic blade 7 and the developing blade 5 to the free end edge of the elastic blade 7 is gradually reduced toward the longitudinal end of the elastic blade 7, outside the image developing region; it may be modified in various ways within the scope of the present invention.

Figure 5:
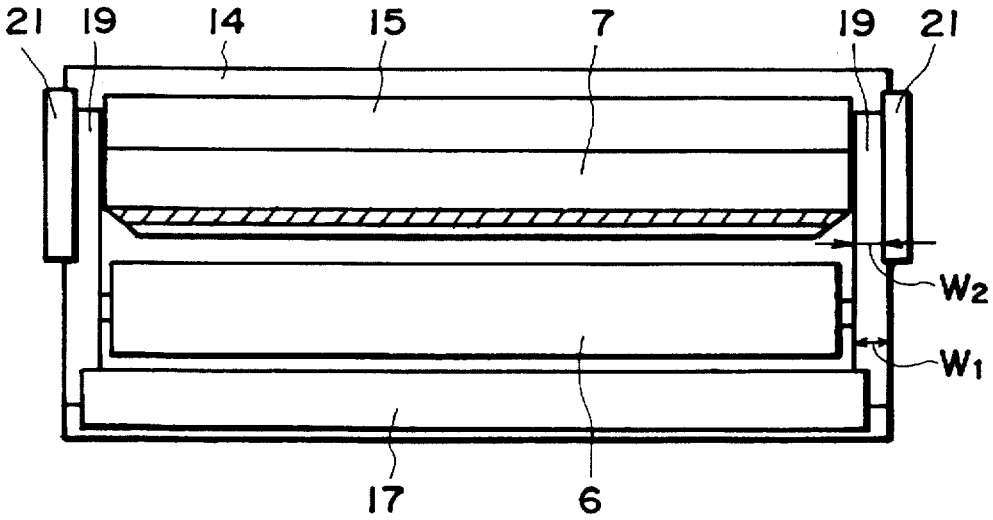
FIG. 5 is a schematic drawing of the developing apparatus in the second embodiment of the present invention, as seen from the direction of the photosensitive member.

Next, referring to FIG. 5, the developing apparatus in another embodiment of the present invention will be described.

This embodiment is characterized in that a pressing member 21 is disposed on the outward side of the end seal 19 placed in contact with an elastic blade 27. The other structural elements are the same as those described in the preceding embodiment. This pressing member 21 presses the end seal 19 toward the longitudinal end surface of the elastic blade 7.

In this embodiment, the structure of the developing container 34 is such that the pressing member 21 is inwardly placed from outside in the longitudinal direction, and is fixed to a predetermined position using small screws or the like. More specifically, the pressing member 21 is positioned so that when the pressing member 21 is fixed against the end seal 19 having a width $W_1$ of 5 mm, a width $W_2$ becomes 4 mm.

With the implementation of the above described structure, the resiliency of the end seal 19 compressed by the pressing member 21 enhances the airtightness between the longitudinal end surface of the elastic blade 7 and the end seal 19, more reliably preventing the toner leak.

Also in this embodiment, the resiliency of the end seal 19 is optimally used by fixing the pressing member 21 to the developer container 14. However, the end seal 19 may be pressed from outside with the use of a spring or the like. In essence, any structure is acceptable as long as it presses the lateral surface of the end seal 19 toward the longitudinal end surface of the elastic blade 17.

Figure 6:
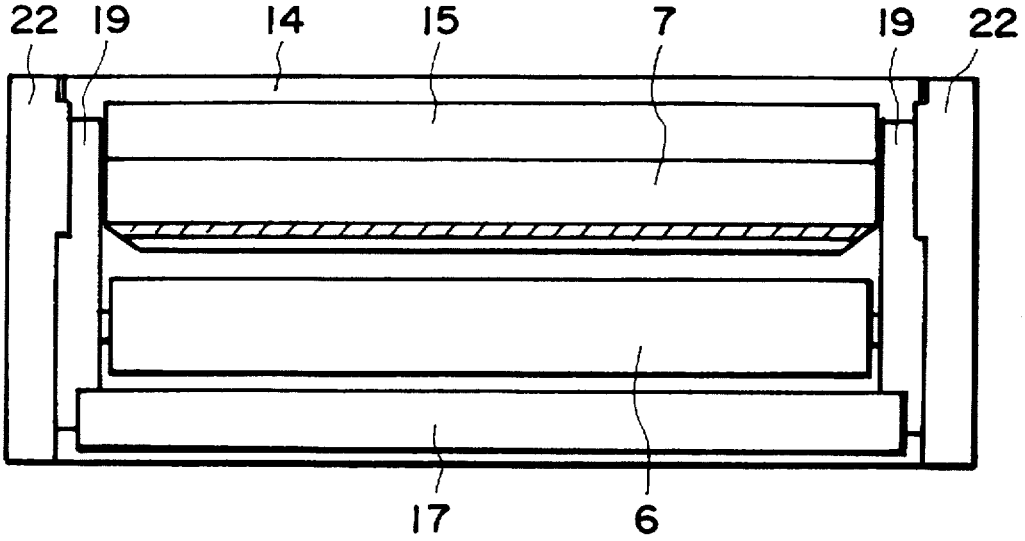
FIG. 6 is a schematic drawing depicting the modification of the developing apparatus described in the second embodiment.
Figure 7:
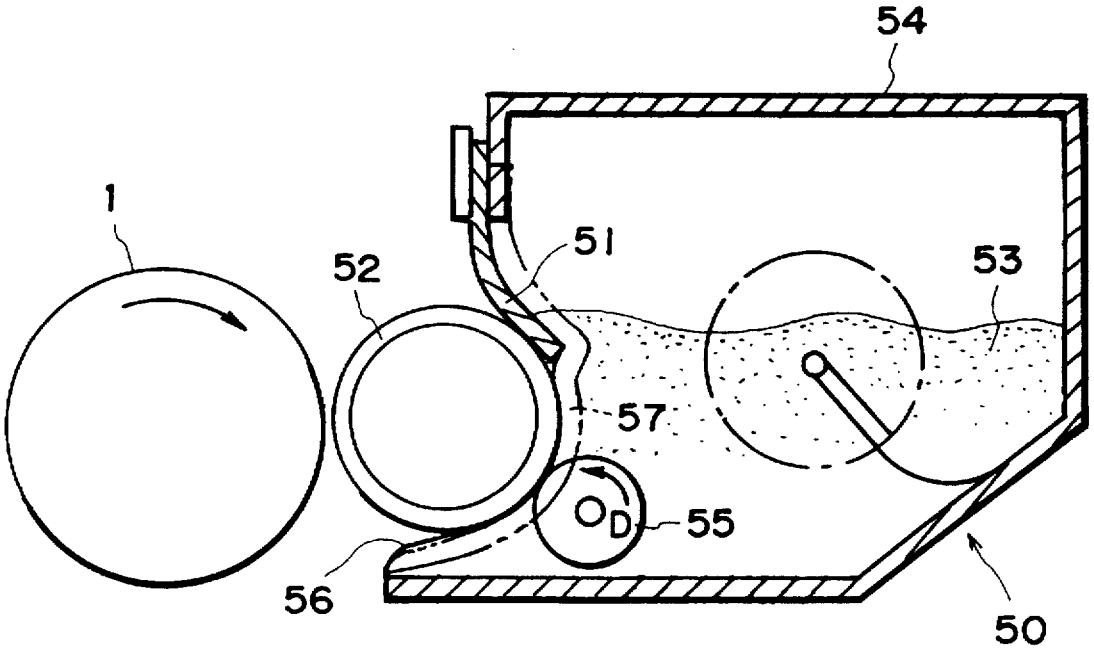
FIG. 7 is a schematic section of a conventional developing apparatus employing nonmagnetic single component toner, depicting the structure thereof.
Figure 8:
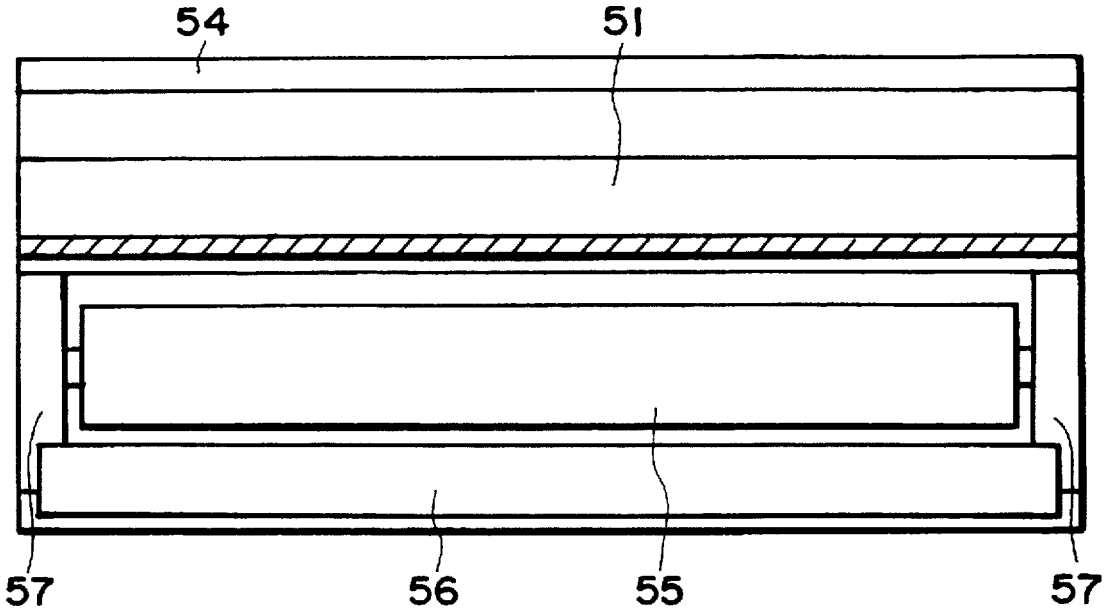
FIG. 8 is a schematic view of the developing apparatus illustrated in FIG. 7, as seen from the direction of the photosensitive member.
Figure 9:
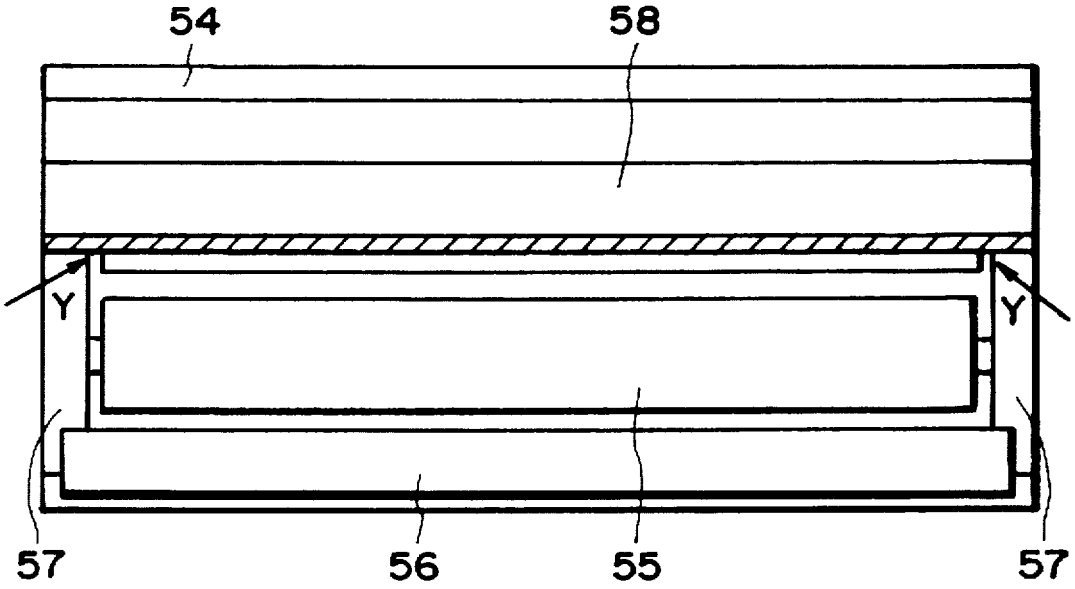
FIG. 9 is a schematic view of another conventional developing apparatus, as seen from the direction of the photosensitive member.

Further, referring to FIG. 6, a bearing 22 which axially supports the developing sleeve 5 may be structured so that it can be externally attached, wherein a portion of the bearing can be usable to press the lateral surface of the end seal. With this structure, the degree of airtightness between the end seal 19 and the elastic blade 7 can be simply improved without necessarily providing a dedicated pressing member.

The structures and components described in the first and second embodiments may be employed in optional combinations as needed, within the scope of the present invention.

Further, in the first embodiment, the developing apparatus was described as a developing apparatus in the form of a process cartridge removably installable in the main assembly of an image forming apparatus. However, a developing apparatus in accordance with the present invention may be in the form of such a developing apparatus that is permanently fixed in the main assembly of an image forming apparatus, and is replenished with toner when necessary, or may be incorporated in a process cartridge which integrally comprises a photosensitive drum, a cleaning blade, a waste toner container, and a charging apparatus, in addition to a developing apparatus, and is removably installable in the main assembly of an image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. A developing apparatus comprising:

a developer container for containing a developer;

a developer carrying member, disposed in an opening of said developer container, for carrying the developer;

an elastic blade for forming a nip between said developer carrying member to regulate an amount of the developer on said developer carrying member;

wherein an end, in a movement direction of said developer carrying member, of said elastic blade is outwardly extended, and an extension length thereof continuously increases away from an edge, in a direction perpendicular to the movement direction, of said elastic blade toward a central portion, and wherein the edge of said elastic blade is in the nip, and a portion of the end of said elastic blade extends beyond the nip.

2. An apparatus according to claim 1, wherein the developer is a non-magnetic one component toner.

3. An apparatus according to claim 1, wherein the end is a free end.

4. An apparatus according to claim 1, wherein the upstream end of said elastic blade is linear where the extension length continuously increases.

5. An apparatus according to claim 1, wherein the upstream end of said elastic blade is curved where the distance continuously increases.

6. An apparatus according to claim 1, further comprising an end seal, provided between an end of said developer carrying member and an edge of the opening of said developer container, for preventing leakage of the developer.

7. An apparatus according to claim 6, wherein said end seal is provided adjacent to a side surface of said elastic blade.

8. An apparatus according to claim 7, further comprising an urging member for urging said end seal toward said elastic blade.

9. An apparatus according to claim 8, wherein said urging member functions also to rotatable support said developer carrying member.

10. An apparatus according to claim 2, wherein said developer has a shape factor SF-1 of 100–180 and a shape factor SF-2 of 100–140.

* * * * *

UNITED STATES PATENT AND TRADEMARK OFFICE

CERTIFICATE OF CORRECTION

PATENT NO. : 5,895,151

DATED : April 20, 1999

INVENTOR(S) : MASAHIDE KINOSHITA, ET AL.

It is certified that error appears in the above-identified patent and that said Letters Patent is hereby corrected as shown below:

COVER PAGE ITEM [56] FOREIGN PATENT DOCUMENTS,
"0-810488 3/1997 European Pat. Off." should read --0-810488 12/1997 European Pat. Off.--.

COLUMN 2,
Line 8, "developing." should read --developing--; and
Line 48, "above described" should read --above-described--.

COLUMN 4,
Line 15, "Loner" should read --toner--;
Line 32, "interior" should read --interior of--;
Line 43, "above described" should read --above-described--; and
Line 65, "of" should read --of a--.

COLUMN 6,
Line 8, "drum 1" should read --drum 1.--;
Line 13, "in." should read --in--;
Line 23, "above" should read --above- --; and
Line 36, "is" should read --is a--.

COLUMN 7,
Line 8, "of" should read --of a--.

UNITED STATES PATENT AND TRADEMARK OFFICE

CERTIFICATE OF CORRECTION

PATENT NO. : 5,895,151

DATED : April 20, 1999

INVENTOR(S) : MASAHIDE KINOSHITA, ET AL.

It is certified that error appears in the above-identified patent and that said Letters Patent is hereby corrected as shown below:

COLUMN 10,
Line 30, "zero" should read --zero.--; and
Line 50, "above described" should read --above-described--.

COLUMN 12,
Line 46, "above described" should read --above-described--.

COLUMN 12,
Line 60, "rotatable" should read --rotatably--.

Signed and Sealed this

Second Day of November, 1999

*Attest:*

Q. TODD DICKINSON

*Attesting Officer*

*Acting Commissioner of Patents and Trademarks*